United States Patent [19]

Gibson

[11] 4,224,740

[45] Sep. 30, 1980

[54] PANTS SUIT PATTERN

[76] Inventor: Donald A. Gibson, 2940 Pease Dr., Rocky River, Ohio 44116

[21] Appl. No.: 913,857

[22] Filed: Jun. 8, 1978

[51] Int. Cl.[3] ..... A41H 3/00

[52] U.S. Cl. ..... 33/17 A; 33/12

[58] Field of Search ..... 33/12, 14, 16, 17 R, 33/17 A, 11

[56] References Cited

U.S. PATENT DOCUMENTS

| | | | |
|---|---|---|---|
| 937,214 | 10/1909 | Kellogg | 33/11 |
| 1,256,029 | 2/1918 | McClaugary | 33/11 |
| 1,416,383 | 5/1922 | Rosk | 33/12 |

*Primary Examiner*—Willis Little

*Attorney, Agent, or Firm*—Fay & Sharpe

[57] ABSTRACT

A pants suit pattern that is made to fit an individual having measurements not of the standard or average size and one that is made from a master pattern. A pants suit pattern per se is, of course, the foundation from which fitted slacks, jeans, culottes and shorts may be produced. Thus, it is desirable for the woman who does not fit into standard size, ready-made clothes to choose a pants suit pattern which may be fitted to her individual measurements and provide her with a pair of neatly tailored pants or other carefully made pieces for her wardrobe.

The individualized pattern of this invention does just that. It is made from tissue paper and marked over a master pattern. The master pattern has graded measurements on its peripheral sides in outward, upward and downward directions but not on its center front. A pattern is made by cutting and marking these graded measurements to an individual's measurements with the use of a straight edged and curved tool. The tissue pattern may be transferred onto a nylon fabric or working pattern. Built right into the pattern is desired ease and seam allowances of one-half inch except for the waistline and waistband seams which permit one-quarter inch allowance.

The pattern is truly an innovation over other variable sized patterns in that it uses a measurement from the center front waistline to the center back waistline or crotch measurement in order to fit the pants to a wearer, and provides for a simplified procedure for so doing.

3 Claims, 3 Drawing Figures

FIG. 1
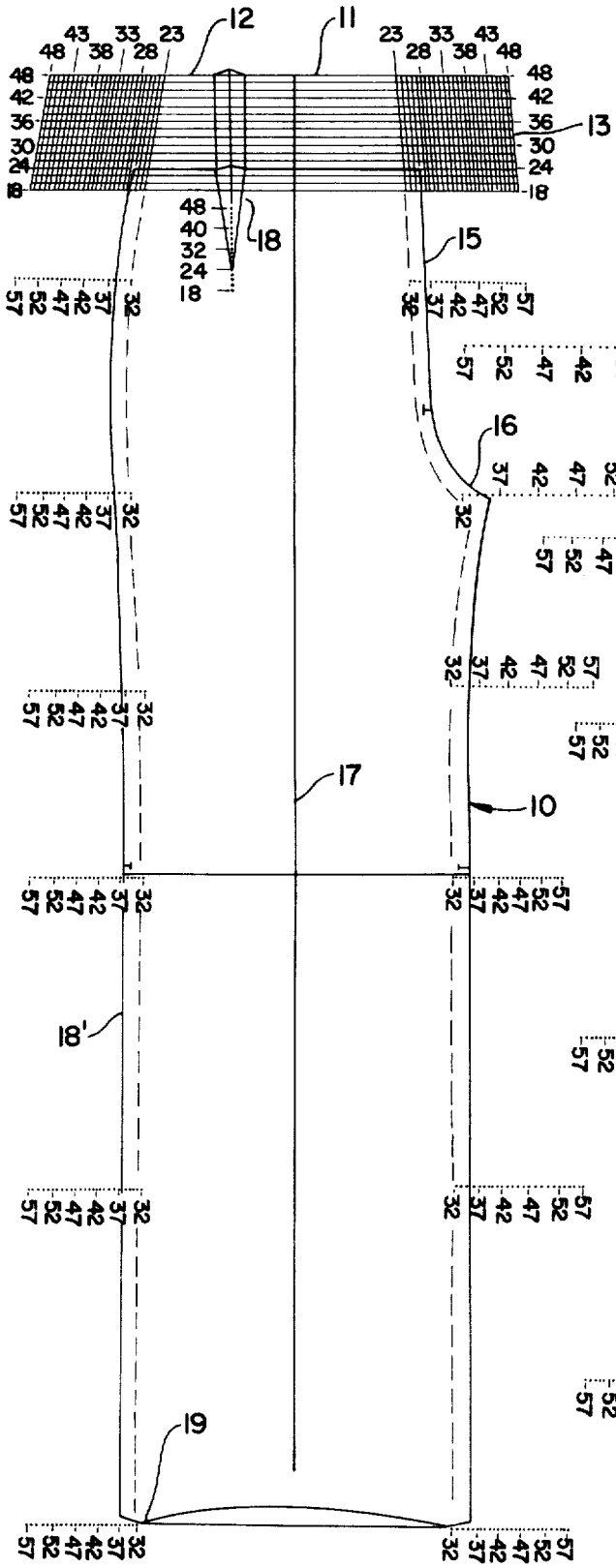
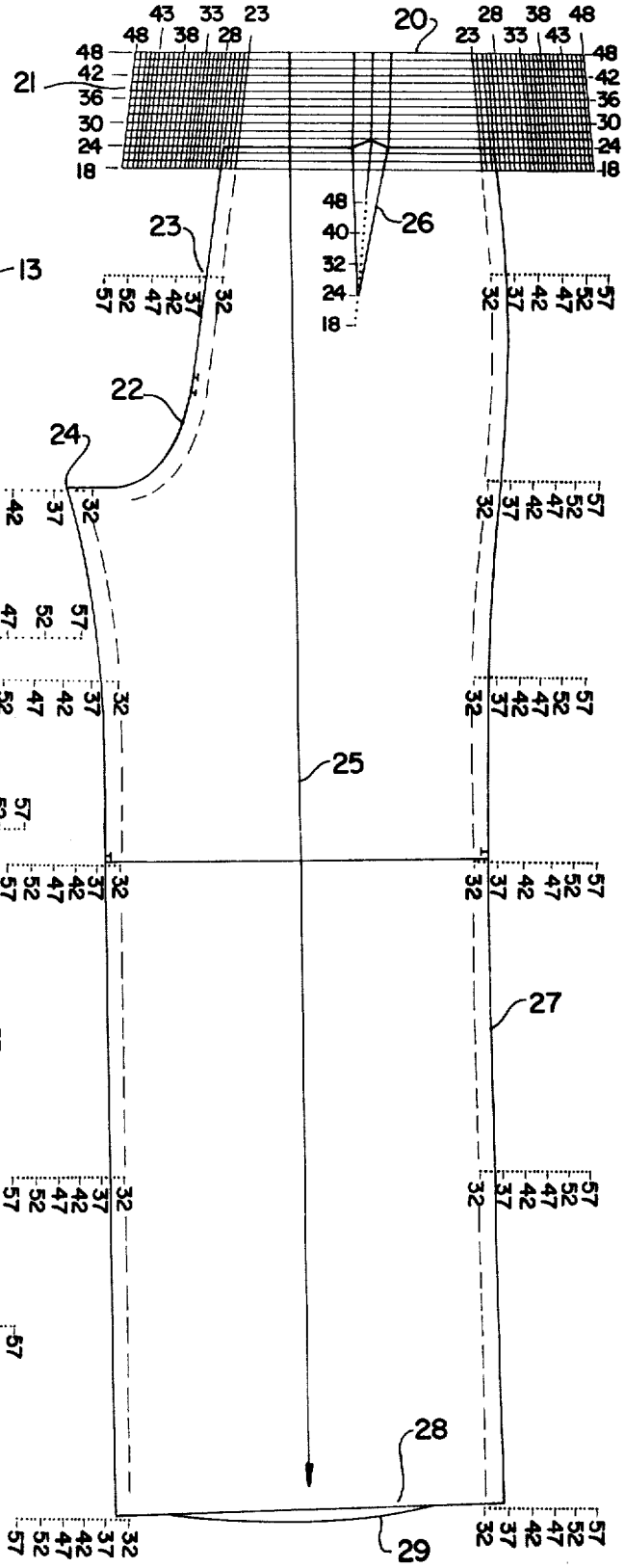
FIG. 2

PANTS SUIT PATTERN

BACKGROUND OF THE INVENTION

Pants and pants suit patterns are old in the art, and at least some are known to incorporate graded measurements, but this invention is characterized by its use of a different kind of measurement to provide the correct foundation for a pattern. A waistline through the crotch to the back waistline is provided herein which may then be marked on a portion of the pattern or "grid" section thereof to aid in dimensioning the pattern to an individual user's measurements.

Other prior patterning techniques have employed measurements of waistline to crotch but manipulated certain steps for the modification of waistlines which has proved to be a cumbersome and somewhat inaccurate concept.

BRIEF DESCRIPTION OF THE INVENTION

The present invention is directed to a master pattern of varying size which is adapted to fit almost any wearer, from the smallest to the largest size measurements. There is a master pattern with graded marks thereon which by means of a straight edge and curves maintains the proper connections for a pants suit pattern. The master pattern provides for a much improved fit and for improved workability while handling.

BRIEF DESCRIPTION OF THE DRAWINGS

Details of the preferred embodiment of this invention are described in detail in this specification and are illustrated in the accompanying drawings which form a part hereof, wherein:

FIG. 1 in a plan view of the front of the pants suit pattern;

FIG. 2 is a plan view of the rear of the pants suit pattern; and

MEASUREMENTS

Figure 3:
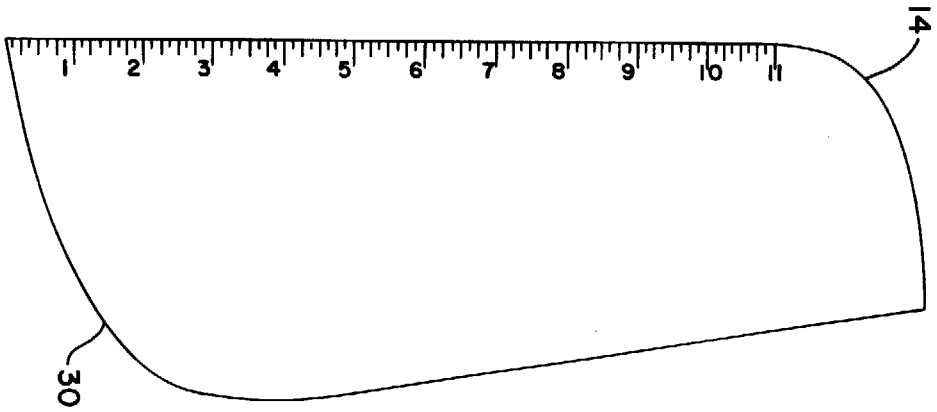
FIG. 3 is a plan view of the curved and straight edged tool.

For the reason that correct measurements are essential to a well-fitting pants suit pattern, there follow descriptions and definitions to permit an understanding of this invention:

Waistline

To define the natural waistline, place a narrow belt, ribbon or elastic strip comfortably about the waist. Measure where the belt, ribbon or elastic "finds" the natural waistline.

Widest Hip

Measure the widest hip around the fullest part of the hip which should be from 7–9 inches below the natural waistline.

Outside Seam Length

Measure from waistline down side seam to desired length. This measurement should be taken for the type of shoes normally worn with slacks.

Crotch Measurement

Place end of tape at center front waistline, through the legs and up to the center back waistline.

DESCRIPTION OF THE PREFERRED EMBODIMENT

Referring now to the drawings wherein the showings are for purposes of illustrating the preferred embodiment of the invention only and not for purposes of limiting same, the figures concern the following:

The present invention in a pants suit pattern requires the use of a master pattern, a tissue overlay, and straight edge and curves, the latter of these for outlining the tissue pattern which serves as the foundation for making the pants of the pants suit, and later sewn.

Basically the steps include:

Lay out the master pattern for the front of the pants 10 on a table surface, and then extend over the master pattern the tissue provided for this purpose. At the top of the pants pattern is a grid section 11 which extends from each corner of the pattern in upward and outward directions, one dimension of which is the waistline shown laterally in the drawing at 12 and the other dimension of which is the crotch measurement 13. The crotch measurement is from the front waistline through the crotch to the back waistline.

It is most desirable to first mark the dots on the tissue in accordance with the waistline masurement, then move up or down on the waistline until the line is reached that represents the crotch measurement. Mark these two positions and connect them with a straight edge and then continue to mark all the graded measurements on the pants pattern in accordance with the widest hip measurement.

The front crotch 15 is connected by following these steps: Use the small curve 14 (FIG. 3) and connect the dots from the middle of the crotch seam to the bottom of the crotch seam 16. Using the straight edge tool, connect the dots from the middle of the crotch seam up to the waistline dot 11. Using the curved edges and straight edges of the tool, finish connecting all the remaining dots on the tissue down to the bottom grid. Also, draw in the grain line 17 on the pattern by using the straight edge of the tool and then draw in the waistline dart 18. The point of the waistline dot is the number which corresponds to the crotch measurement. From that point, draw straight lines up to the intersection of the waistline 11. Then take the tape measure and measure down the outseam 18' from the waistline to the desired length. This is a measurement that has been taken for the proposed user. Using the grain line as a track, move the tissue paper up or down until the outside seam length mark, just before made, lines up with the master pattern hemline 19. The curved tool is then used to trace the contour of the hemline. Note how the contour of the hemline goes up on the front pattern and down on the back pattern, which permits arching of the foot.

See FIG. 2 for the back master pattern. The process is repeated. Place the tissue over the master pattern, lay out the waistline by marking the grid 20 on the master pattern with the waistline of the wearer and mark the crotch dimension on the other coordinates of the grid 21, and draw in the waistline from the two marks. Connect all other dots on the graded measurements of the master pattern, draw in and connect these dots by curves 30 and straight lines as required. The back crotch 22 is accomplished in two steps: Using one particular side of the curve 30 on the curved tool, connect the dots from the middle of the crotch seam 23. Connect the dots from the middle of the crotch seam to the bottom of the crotch seam 24, and using the straight edge of the tool, connect the dots from the middle of the crotch seam up to the waistline dot. Finish the remaining dots on the tissue pattern with the curved edge and straight edge, as required, and add the grain line 25 with the straight edge of the tool. Also with the straight edge, mark in the waistline dart 26. The point of the waistline dart is the number that corresponds with the crotch measurement. From this point, draw straight lines up to the intersection of the waistline with the straight edge of the tool. Lay the tape measure down the outside seam 27 from the waistline to desired length. Using the grain line as the track, move the tissue up or down until the outside seam 27 length mark, just made before, lines up with the master pattern hemline 28. Use the curved tool to trace the contour of the hemline and provide about a one-inch hem. The hemline goes down at 29 on the back pattern.

The invention has been described with reference to a preferred embodiment. Obviously, modifications and alterations will occur to others upon the reading and understanding of this specification. It is the intent herein to include all such modifications and alterations insofar as they come within the scope of the appended claims or the equivalents thereof.

I claim:

1. A method of making a pants front pattern from a master pattern, and characterized by including graded measurement outwardly from said pattern based on the waistline, widest hip, outside seam length, crotch measurement or front waistline to center back waistline, wherein there is a grid on either side of the waist, one dimension of which is for the waist measurement and the other dimension of which is for the crotch measurement;

the method which employs a straight edge and curves for drawing the pants pattern, comprising:

A. placing a tissue over a master pattern;

B. marking the tissue over the waist grid for the waist measurement and moving same with respect to the grid for crotch measurement;

C. connecting waist marks to form the waistline;

D. marking all graded measurements according to the widest hip measurement;

E. connecting all graded measurements to form a pants pattern on said tissue; and F. using a curve for connecting the marks on the graded measurement of the lower portion of the crotch and then completing the marks with the straight edge;

2. The method of claim 1 comprising marking the master pattern hemline and hem with respect to the outside seam length and moving the pants pattern tissue to register the hem outside seam mark with the master pattern hemline and then marking the hemline contour with the aid of the curve.

3. A variable sized pants pattern having an outline of its front and back panels for making up pants and having graded measurements outwardly thereon;

said pattern having waistband grids with indicia on said band for marking the waistband to make it larger or smaller than the pattern as required;

said pattern having a further set of indicia in grid form and generally positioned perpendicular to said waistband for the crotch dimension; and said pattern having a dart as shown on the pattern at the waistline with the apex of the dart being scaled to the crotch dimension.

* * * * *